US009328699B2

(12) United States Patent
Dudar et al.

(10) Patent No.: US 9,328,699 B2
(45) Date of Patent: May 3, 2016

(54) PHEV EVAP SYSTEM CANISTER LOADING STATE DETERMINATION

(71) Applicant: FORD GLOBAL TECHNOLOGIES, LLC, Dearborn, MI (US)

(72) Inventors: Aed M. Dudar, Canton, MI (US); Dennis Seung-Man Yang, Canton, MI (US); Mark Daniel Bunge, Dearborn, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 401 days.

(21) Appl. No.: 14/040,684

(22) Filed: Sep. 29, 2013

(65) Prior Publication Data

US 2015/0090234 A1 Apr. 2, 2015

(51) Int. Cl.

| | |
|---|---|
| ***F02M 25/08*** | (2006.01) |
| ***F02D 41/00*** | (2006.01) |
| *F02D 29/02* | (2006.01) |

(52) U.S. Cl.

CPC ..... *F02M 25/0854* (2013.01); *F02D 41/0045* (2013.01); *F02M 25/089* (2013.01); *F02D 29/02* (2013.01); *F02D 2200/0606* (2013.01)

(58) Field of Classification Search

CPC . F02M 25/08; F02M 25/089; F02M 25/0854; F02D 41/0045; F02D 29/02; F02D 2200/0606

See application file for complete search history.

(56) References Cited

U.S. PATENT DOCUMENTS

| | | | | |
|---|---|---|---|---|
| 8,935,044 | B2 * | 1/2015 | Yang | F02M 25/08 123/518 |
| 2014/0324284 | A1 * | 10/2014 | Glinsky | G07C 5/006 701/34.4 |
| 2014/0360260 | A1 * | 12/2014 | Dudar | F02M 25/08 73/204.11 |

* cited by examiner

*Primary Examiner* — Hieu T Vo
(74) *Attorney, Agent, or Firm* — Joseph E. Root

(57) ABSTRACT

An evaporative emission control system for a plug-in hybrid electric vehicle that indicates the level of loading of a carbon canister of the system. The system has multiple thermocouples positioned space apart from each other along a vapor flow path within the carbon canister. A controller is connected to each thermocouple, which monitors the temperature of the thermocouples. The controller indicates the level of saturation of the carbon canister based on certain pre-determined temperature criteria.

12 Claims, 8 Drawing Sheets

Prior-art

PHEV EVAP SYSTEM CANISTER LOADING STATE DETERMINATION

TECHNICAL FIELD

Embodiments of the present disclosure generally relate to Evaporative Emission Control Systems (EVAP) for automotive vehicles, and, more specifically, to carbon canisters disposed within EVAP systems.

BACKGROUND

Gasoline, used as an automotive fuel in many automotive vehicles, is a volatile liquid subject to potentially rapid evaporation, in response to diurnal variations in the ambient temperature. Thus, the fuel contained in automobile gas tanks presents a major source of potential evaporative emission of hydrocarbons into the atmosphere. Such emissions from vehicles are termed 'evaporative emissions'. The engine produces such vapors even while being is turned off.

Industry's response to this potential problem has been the incorporation of evaporative emission control systems (EVAP) into automobiles, to prevent fuel vapor from being discharged into the atmosphere. EVAP systems include a canister (the carbon canister) containing adsorbent carbon) that traps fuel vapor. Periodically, a purge cycle feeds the captured vapor to the intake manifold for combustion, thus reducing evaporative emissions.

Hybrid electric vehicles, including plug-in hybrid electric vehicles (HEV's or PHEV's), pose a particular problem for effectively controlling evaporative emissions with this kind of system. Although hybrid vehicles have been proposed and introduced having a number of forms, these designs share the characteristic of providing a combustion engine as backup to an electric motor. Primary power is provided by the electric motor, and careful attention to charging cycles can result in an operating profile in which the engine is only run for short periods. Systems in which the engine is only operated once or twice every few weeks are not uncommon. Purging the carbon canister can only occur when the engine is running, of course, and if the canister is not purged, the carbon pellets can become saturated, after which hydrocarbons will escape to the atmosphere, causing pollution.

Over time, the canister pellets become loaded with hydrocarbons. Adsorption occurs during refueling operations, diurnal temperature variations, and running vapor losses. The primary loading source is refueling, as the fuel tank is sealed to contain diurnal and running vapor generation. If not purged for some time, the canister can reach saturation, which presents a risk that additional vapor can result in vapor escaping to the atmosphere. Therefore, identifying the loading state of the canister is a key step to ensure timely purging.

Conventional automotive vehicles use an oxygen sensor ($O_2$ sensor) to determine the canister's loading state. Being located in the exhaust stream, these sensors identify changes in the air-fuel ratio during purging, which allows the control system to infer the state of canister loading. PHEVs, however, generally experience limited engine running time, which in turn limits the utility of that method. Hydrocarbon sensors provide a substitute method, but they are comparatively expensive.

Considering the problems mentioned above, and other shortcomings in the art, there exists a need for an efficient method and system for identifying the state of loading of a carbon canister within an EVAP system of a PHEV.

SUMMARY

The present disclosure provides a system and a method for identifying the saturation level of a carbon canister of an EVAP system of a plug-in hybrid electric vehicle.

According to an aspect, the disclosure provides an evaporative emission control system for a plug-in hybrid electric vehicle, configured to indicate a fully saturated state of a carbon canister of the system. The system includes multiple thermocouples positioned spaced apart from each other along a vapor flow path within the canister. A controller is operatively connected to each thermocouple, and it monitors the temperature of the thermocouples. Based on certain pre-determined temperature criteria, the controller indicates the level of saturation of the carbon canister.

According to another aspect, this disclosure provides a method for determining the level of saturation of a carbon canister within an EVAP system of a PHEV. The method positions multiple thermocouples spaced apart from each other along a vapor flow path within the carbon canister. During a preselected time period, a controller monitors the temperature detected by each thermocouple, and identifies an inflection point in the temperature variation as a function of time for each thermocouple. The method then indicates a fully saturated state of the carbon canister based on preselected criteria related to the identified inflection points.

Additional aspects, advantages, features and objects of the present disclosure would be made apparent from the drawings and the detailed description of the illustrative embodiments construed in conjunction with the appended claims that follow.

DETAILED DESCRIPTION OF ILLUSTRATIVE EMBODIMENTS

The following detailed description illustrates aspects of the disclosure and its implementation. This description should not be understood as defining or limiting the scope of the present disclosure, however, such definition or limitation being solely contained in the claims appended to the specification. Although the best mode of carrying out the invention has been disclosed, those in the art would recognize that other embodiments for carrying out or practicing the invention are also possible.

Environmental regulators are steadily tightening the standards for vehicle vapor emissions. Environmental authorities in certain regions, such as California, typically require less than about 500 mg of hydrocarbons released as vehicle evaporative emissions in a standard 3 day test. Given other sources of emissions, that standard effectively limits canister emissions to less than about 200 mg. Euro 5/6 regulations enforce a limit of about 2 grams of evaporative emissions per day.

Such stringent conditions demand a highly efficient and effective evaporative emission control system, which in turn should by leakage free.

The On-Board Diagnostic regulations mandate that the EVAP system of a vehicle should be regularly checked for leakage. It is imperative to have an idea of the loading state/level of the canister of the EVAP system, as a fully loaded canister is highly prone to dissipating the hydrocarbon vapors into the atmosphere.

Conventionally, automotive EVAP systems use oxygen sensors ($O_2$ sensors) to determine the level of loading of the canister. An electronically operated $O_2$ sensor is located in the exhaust stream of the engine. It measures the proportion of oxygen in the exhaust gas, from which it determines whether the air-fuel ratio is rich or lean. The automobile's control system uses that feedback to roughly calculate the level of canister loading. In PHEVs, however, limited engine running time similarly limits the utility of that method This disclosure provides an efficient method for determining the loading state of a canister in a PHEV EVAP system.

Figure 1:
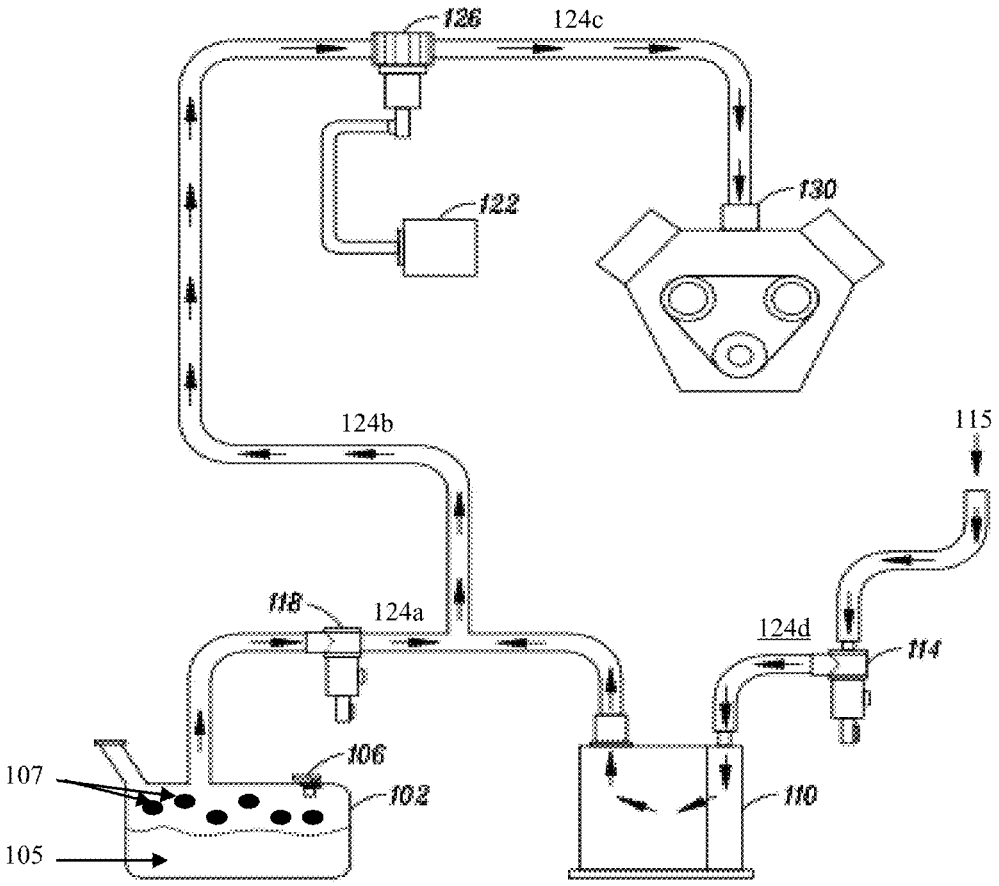
FIG. 1 is a schematic view of a conventional Evaporative Emission Control System configured to reduce evaporative emissions through a vehicle.

FIG. 1 illustrates a conventional evaporative emission control system 100. As seen there, the system is made up primarily of a fuel tank 102, a carbon canister 110, and the engine intake manifold 130, all joined by lines and valves. It will be understood that many variations on this busy design are possible, but the illustrated embodiment follows the general practice of the art. It will be further understood that the system 100 is generally sealed, with no open vent to atmosphere.

Fuel tank 102 is partially filled with liquid fuel 105, but a portion of the liquid will evaporate over time, producing fuel vapor 107 in the upper dome portion of the tank. The amount of vapor produced will depend upon a number of environmental factors. Of these factors, ambient temperature is probably the most important, particularly given the temperature variation produced in the typical diurnal temperature cycle. For vehicles in a warm climate, particularly a hot, sunny climate, the heat produced by leaving a vehicle standing in direct sunlight can produce very high pressure within the vapor dome of the tank, producing huge amount of vapors within the fuel tank. A fuel tank pressure sensor (FTPT) 106 monitors the pressure in the fuel tank vapor dome.

Vapor lines 124 join the various components of the system. One portion of that line, line 124*a* runs from the fuel tank 102 to carbon canister 110. A normally-closed Fuel tank isolation valve (FTIV) 118 regulates the flow of vapor from fuel tank 102 to the carbon canister 110, so that vapor generated by evaporating fuel can be adsorbed by the carbon pellets under control of the PCM 122. Vapor line 124*b* joins line 124*a* in a T intersection beyond valve 118, connecting that line with a normally closed canister purge valve (CPV) 126. Line 124*c* continues from CPV 126 to the engine intake manifold 130. Both CPV 126 and FTIV 118 are controlled by signals from the powertrain control module (PCM) 122.

Canister 110 is connected to ambient atmosphere at vent 115, through a normally closed canister vent valve (CVV) 114. Vapor line 124*d* connects that vent 115 to the canister 110. CVV 114 is also controlled by PCM 118.

During normal operation, valves 118, 126, and 114 are closed. When pressure within vapor dome of the fuel tank 102 rises sufficiently, under the influence, for example, of increased ambient temperature, the PCM opens valve 118, allowing vapor to flow to the canister 110, where carbon pellets can adsorb fuel vapor. Similarly, refueling generates considerable vapor, so FTIV 118 is opened during those operations, allowing vapor to flow to canister 110.

To purge the canister 110, valve 118 is closed, and valves 126 and 114 are opened. It should be understood that this operation is only performed when the engine is running, which produces a vacuum at intake manifold 130. That vacuum causes an airflow from ambient atmosphere through vent 115, canister 110, and CPV 126, and then onward into intake manifold 130. As the airflow passes through canister 110, it entrains fuel vapor from the carbon pellets. The fuel vapor mixture then proceeds to the engine, where it is mixed with the primary fuel/air flow to the engine for combustion.

Figure 2:
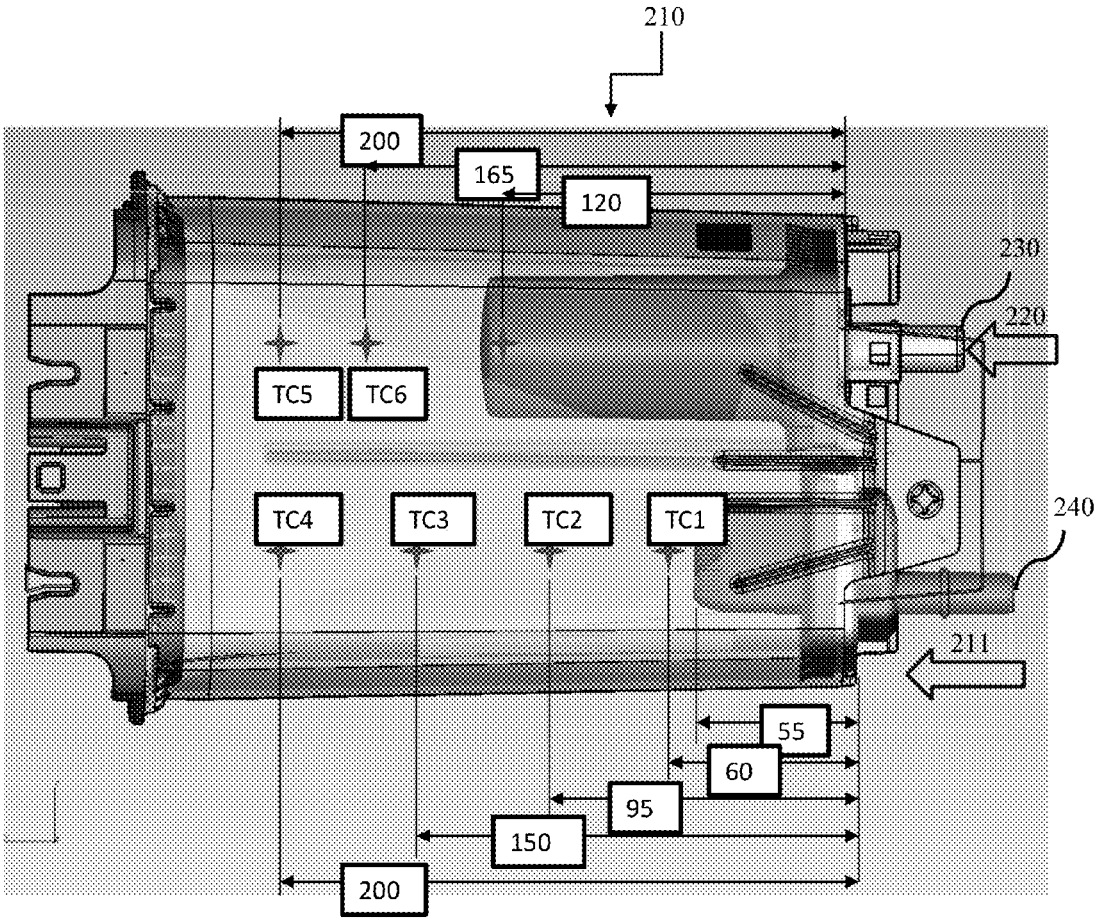
FIG. 2 illustrates a canister of an Evaporative Emission Control System of the present disclosure, having multiple temperature sensors disposed within it, at different locations.

FIG. 2 depicts a canister 210 of an EVAP system incorporated in a PHEV, according to the present disclosure. As seen there, a number of thermocouples TC1-TC6 are positioned along the vapor flow path within the canister 210. Fuel vapors 211 enter the canister 210 through a vapor inlet port 240 communicating with the fuel tank through an FTIV (not shown). Similarly, a port 230 opens to the ambient atmosphere, allowing fresh air to enter during purging.

Multiple thermocouples, TC1-TC6 are spaced along the vapor flow path within the canister 210. The numbers shown in the lower rectangular boxes represent the approximate distances (in millimeters) of each thermocouple from the vapor inlet port 240. For example, the first thermocouple, TC 1, is positioned at about 55 mm. from the port 240, and the farthest thermocouples TC 4 and TC 5 are positioned at about 200 mm from ports 240 and 220, respectively. Further, in the depicted embodiment, the thermocouples are located at increments of 15% partitions within the canister 210. Therefore, TC 1 is positioned at 15% partition mark from the vapor inlet, TC 2 at 30%, and so on. In that respect, the canister 210 has different thermocouples disposed within different zones, to measure the temperature rise within those zones.

Though only six thermocouples are shown, some embodiments may employ more thermocouples, for a higher precision and accuracy. Further, the depicted distances of the thermocouples from the vapor inlet port 240, are merely exemplary, and may vary in different embodiments, based on certain factors, such as the size and capacity of the canister 210.

During vehicle refueling and canister purging, each thermocouple measures the interior temperature of the canister 210 at its location. As the fuel tank is refueled, the carbon pellets within the canister adsorb hydrocarbon vapors emerging from the tank. Adsorption is an exothermic reaction, resulting in an increase in the interior temperature of the canister 210. The EVAP system of the present disclosure utilizes that fact to determine the level of saturation of the canister 210 at any point of time.

As the carbon pellets within each partition zone of the canister 210 adsorb hydrocarbon vapors, the temperature of the thermocouple disposed within that zone rises, until the carbon pellets reach saturation. Thereafter, no more adsorption occurs, but the flow vapor across the pellets produces a cooling effect, and the corresponding thermocouple shows a decrease in temperature. Therefore, saturation of each zone of the canister 210 appears as inflection an inflection point in the temperature curve for that zone. By identifying inflection points in temperature trends, one can infer that the canister 210 is substantially saturated.

A controller (not shown) is coupled to the different thermocouples, to observe their temperature variations and identify inflection points. Those in the art would understand that any conventional electronically operated controller can be employed for the purpose.

In the illustrated embodiment, for example, if only the first thermocouple TC 1 shows an inflection point during refueling, one can infer that the canister 210 is about 15%. Similarly, an inflection point observed in temperature variation of both TC 1 and TC 2 corresponds to a 30% saturation of the canister 210. Finally, if all the thermocouples show inflection points, one can infer that about 90% of the canister is saturated due to refueling. These percentage levels of canister loading may vary in different embodiments, based on the spatial positioning of the thermocouples within the canister 210. Those of skill in the art will be capable of correlating thermocouple positioning and loading results for particular embodiments.

Figure 3:
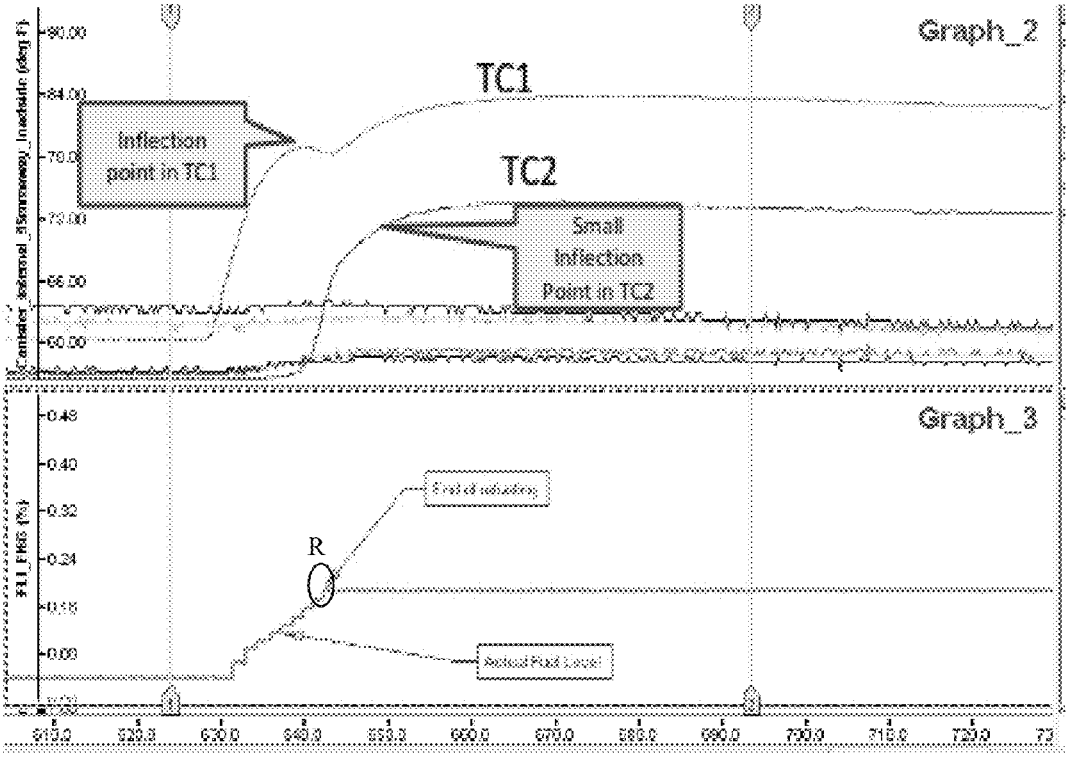
FIG. 3-FIG. 7 illustrate temperature variation curves for the temperature sensors of FIG. 1 during refueling of a PHEV, according to different embodiments of the present disclosure.

FIG. 3 is a graph depicting the temperature variation during refueling, for the first and second thermocouples, TC 1 and TC 2, shown in FIG. 2. Specifically, the upper curve shows the temperature variation for each thermocouple, and the lower curve tracks the fuel level indicator. As seen, by the time the refueling ends at point 'R', the temperature curve for TC 1 reflects an inflection point, while TC 2 still shows a rising temperature curve. Therefore, in the depicted embodiment, finally, one can infer that the canister 210 is at least 15% but not 30% saturated due to the refueling operation.

Figure 4:
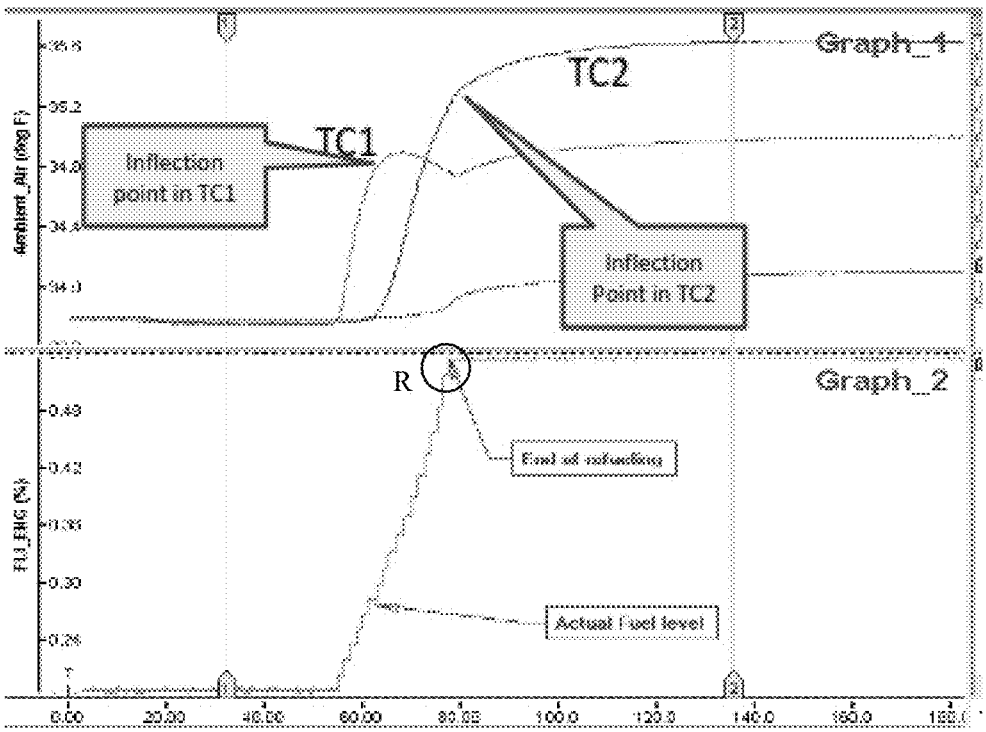

FIG. 4 illustrates another embodiment, where, by the time refueling ends, both the first and second thermocouples TC 1 and TC 2 have shown an inflection point in their temperature curves. TC2 shows an inflection point just at the end of refueling, while TC1 reached its inflection point when the fuel tank was about 28% refueled. In this embodiment, the canister 210 is about 30% loaded due to refueling.

Figure 5:
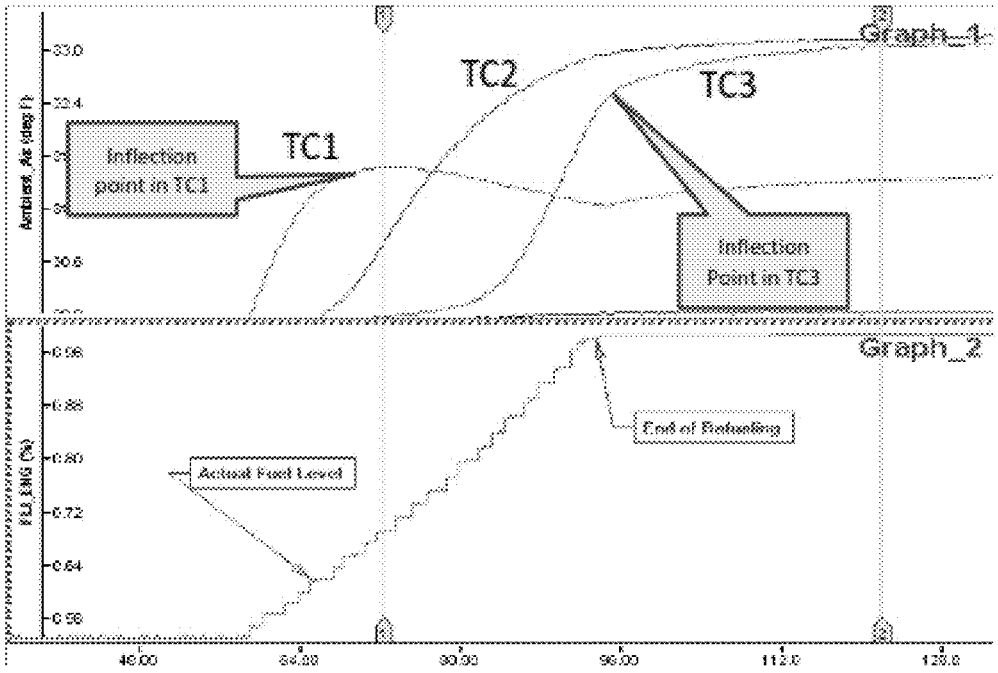

FIG. 5 depicts an embodiment where the thermocouples disposed within the first three partition zones of the canister 210, have reached inflection points by the end of refueling. This time, the canister 210 is about 45% loaded with hydrocarbon vapors.

Figure 6:
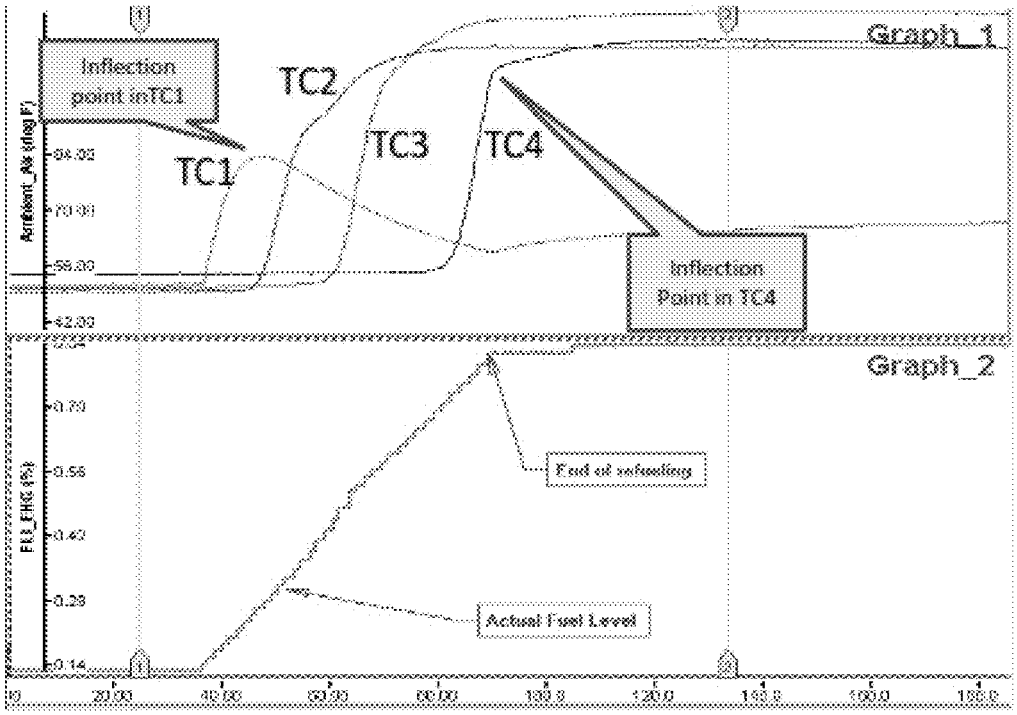

Similarly, FIG. 6 illustrates an embodiment where the first four thermocouples, TC 1-TC 4, achieve inflection points. By the time refueling ends, the loading level of the canister 210 reaches about 60%.

Figure 7:
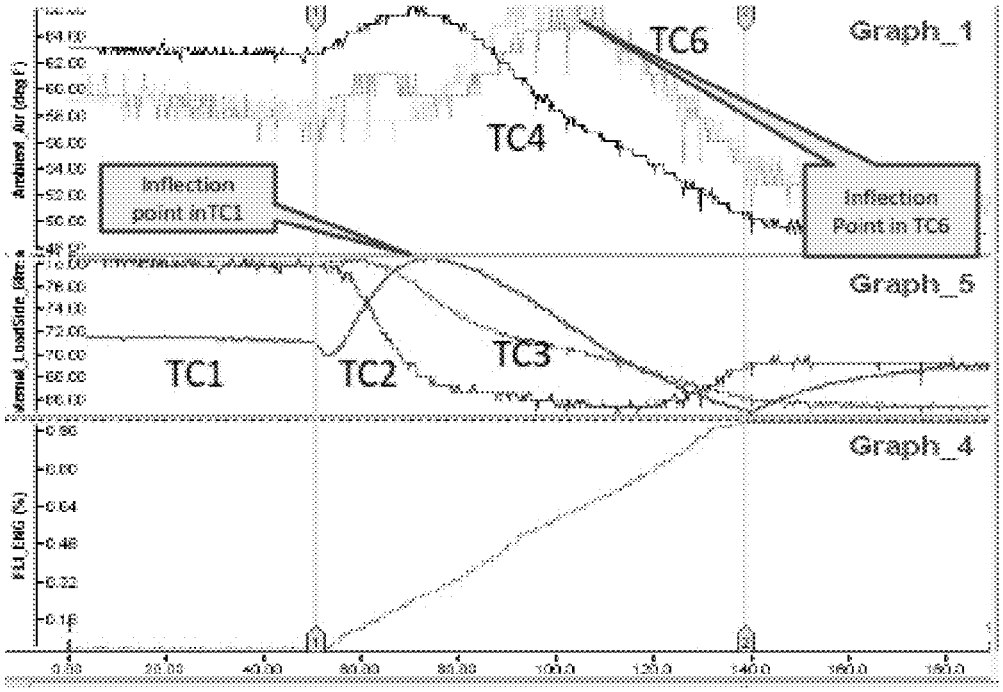

FIG. 7 depicts an embodiment where the canister 210's loading level reaches about 90%, due to refueling, where all the thermocouples, TC 1-TC 6 have reached their inflection points as refueling ends.

In the embodiments shown in FIG. 3-FIG. 7, the actual fuel level corresponding to the inflection points is not related to the canister loading. Rather, canister loading depends on the state of the carbon pellets when refueling begins, as well as other factors related to the speed of hydrocarbon adsorption for the pellets. Deviations from these embodiments are therefore well within the scope of the present disclosure.

Figure 8:
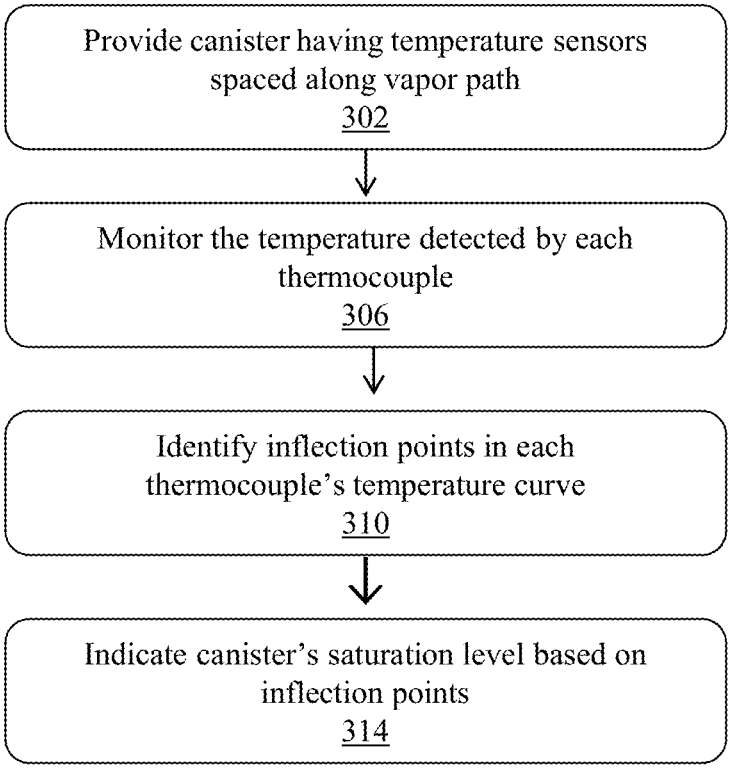
FIG. 8 is a flowchart depicting the different steps involved in a method for identifying the loading level of a canister, according to the present disclosure.

FIG. 8 is a flowchart showing a method for determining the loading level of a canister of a PHEV EVAP system. At the initial step 302, the canister is provided, having temperature sensors. The temperature sensors are positioned along the vapor flow path. In the illustrated embodiment, the sensors are equally spaced along the vapor patent so that each temperature sensor covers a specific fraction of the canister length. According to the positions, a specific loading level is designated for the canister, based on the distances of those canisters from the vapor inlet.

The sensor array output is monitored in step 306. A specific monitoring period is implemented, depending on the nature of the event in question. For refueling, the period could commence when the fuel cap is opened and could continue until refueling is completed, which could be indicated by either a full tank or when the refueling cap is replaced. Alternatively, monitoring could occur if vapor is allowed to flow to the canister 210 for other reasons, such as excessive pressure within the fuel tank.

As sensor signals are monitored, a controller, such as PCM 122 (FIG. 1), evaluates the resulting temperature curve and identifies any inflection points that occur, at step 310. The analysis required to perform that function is well known, and a variety of algorithms can be applied by those in the art to achieve that result. At step 314, the method indicates the level of canister saturation/loading, based on the identified inflection points. Data is present in suitable format and location to correlate given sensor inflection points with loading levels, and that data is accessible by the controller. For example, if all the temperature sensors show inflection points, then the method infers that refueling has substantially loaded the canister with hydrocarbon vapors. On the other hand, if none of the temperature sensors depicts an inflection point, then the canister is minimally loaded. In the illustrated embodiments, each sensor corresponds to 15% of the canister vapor path, and thus successive inflection points each add 15% to the total canister loading. The method and the system of the present disclosure is highly effective in determining the loading level of a canister of an EVAP system of a PHEV, and avoids the use of hydrocarbon sensors, which are otherwise extremely expensive.

Although the current invention has been described comprehensively, in considerable details to cover the possible aspects and embodiments, those skilled in the art would recognize that other versions of the invention are also possible.

We claim:

1. An evaporative emission control system for a plug-in hybrid electric vehicle, configured to indicate the saturated state of a system carbon canister, the system comprising:

a plurality of temperature sensors spaced along a vapor flow path within the carbon canister; and a controller operatively connected to each temperature sensor, for monitoring the temperature of the temperature sensors, the controller being configured to indicate the level of saturation of the carbon canister based on predetermined temperature criteria.

2. The system of claim 1, wherein each temperature sensor is a thermocouple.

3. The system of claim 1, wherein the controller is configured to identify an inflection point in the temperature variation of each temperature sensor as a function of time, the inflection point corresponding to a specific level of saturation of the carbon canister.

4. The system of claim 3, wherein, during a refueling event, a inflection point in the temperature variation as a function of time of the first temperature sensor corresponds to a lowest level of saturation of the carbon canister, and a inflection point in the temperature variation as a function of time of the last temperature sensor corresponds to a substantially saturated level of the carbon canister.

5. The system of claim 1, wherein the plurality of temperature sensors is juxtaposed along the vapor flow path, and a first temperature sensor is positioned nearest to an inlet port of the vapor flow path into the canister, and a last temperature sensors is positioned farthest from the inlet port.

6. The system of claim 1, wherein the predetermined temperature criteria correspond to occurrence of inflection points in the temperature variation as a function of time, for one or more of the plurality of temperature sensors, during a refueling event.

7. The system of claim 1, wherein each of the plurality of temperature sensors is positioned at a specific pre-determined distance from an inlet port for the vapor flow into the canister.

8. A method for determining the level of saturation of a carbon canister in an evaporative emission control system of a plug-in hybrid electric vehicle, the method comprising:

providing a carbon canister having a plurality of temperature sensors spaced apart from each other along a vapor flow path within the carbon canister;

monitoring the temperature detected by each temperature sensor, employing a controller, during a preselected time period;

identifying a inflection point in each temperature sensor's temperature variation as a function of time; and indicating a saturation state of the carbon canister based on preselected criteria related to the inflection point identifications.

9. The system of claim 8, wherein each temperature sensor is a thermocouple.

10. The method of claim 8, wherein the preselected criteria corresponds to occurrence of inflection points in temperature variation as a function of time, in all of the plurality of temperature sensors positioned within the carbon canister, during a refueling event.

11. The method of claim 8, wherein the positioning includes juxtaposing the plurality of temperature sensors along the vapor flow path, such that a first of the plurality of temperature sensors is positioned nearest to an inlet port for the vapor flow into the canister, and a last of the plurality of temperature sensors is positioned farthest from the inlet port.

12. The method of claim 8, wherein, during a refueling event, occurrence of a inflection point in the temperature variation as a function of time for the first temperature sensor corresponds to a lowest level of saturation of the carbon canister, and a inflection point in the temperature variation as a function of time for the last temperature sensor corresponds to a fully saturated state of the carbon canister.

* * * * *